United States Patent [19]

Takei et al.

[11] Patent Number: 4,748,925

[45] Date of Patent: Jun. 7, 1988

[54] OPENING PLATE FOR ATTACHING A LOWER THREAD BOBBIN OF A SEWING MACHINE

[75] Inventors: Shiro Takei; Shuzo Morimoto, both of Tokyo, Japan

[73] Assignee: Janome Sewing Machine Co. Ltd., Tokyo, Japan

[21] Appl. No.: 23,131

[22] Filed: Mar. 2, 1987

[30] Foreign Application Priority Data

Mar. 14, 1986 [JP] Japan ..... 61-36157[U]

[51] Int. Cl.[4] ..... D05B 73/12; D05B 57/04

[52] U.S. Cl. ..... 112/260; 112/184; 112/229

[58] Field of Search ..... 112/1, 184, 191, 193, 112/229, 260

[56] References Cited

U.S. PATENT DOCUMENTS 2,708,892 5/1955 Ayres ..... 112/184

3,071,091 1/1963 Erbland ..... 112/260

FOREIGN PATENT DOCUMENTS 521670 3/1955 Italy ..... 112/260

*Primary Examiner*—Wm. Carter Reynolds

*Attorney, Agent, or Firm*—Michael J. Striker

[57] ABSTRACT

An opening plate which closes a lower thread bobbin is provided with a drawing of a bobbin on its surface. A bobbin drawing is exactly overlapped with the bobbin when the plate is completely closed. Also a drawing of a thread tension adjusting device in a required position and a drawing of a lower thread normal path are provided on the opening plate. The drawings indicate to a machine operator the position of lower thread holding bobbin correctly inserted in a horizontal full rotation loop taker device and the path of drawing of the lower thread therefrom so as to enable the operator to insert the lower thread holding bobbin in the horizontal full rotation loop taker device correctly in place, and pass the lower thread wound on the bobbin through the thread tension adjusting device correctly.

1 Claim, 2 Drawing Sheets

OPENING PLATE FOR ATTACHING A LOWER THREAD BOBBIN OF A SEWING MACHINE

BACKGROUND OF THE INVENTION

This invention relates to an opening plate of a sewing machine, which plates provides access to a lower thread bobbin, and more particularly to an opening plate which illustrates to a machine operator by a position of inserting a lower thread holding bobbin in a horizontal full rotation loop taker device and a path of drawing the lower thread therefrom.

There have been known conventional devices showing the lower thread passing path. However, such devices were not easy for the operators to observe and difficult to serve.

SUMMARY OF THE INVENTION

It is an object of the present invention to provide a device which would inform the machine operator about the exact position of inserting the lower thread holding bobbin in the horizontal full rotation loop taker device and the path of drawing the lower thread therefrom.

According to the invention, it is possible to insert the lower thread holding bobbin in the horizontal full rotation loop taker device correctly in place, and also to pass the lower thread wound on the bobbin through a thread tension regulating device correctly.

The objects of this invention are attained by an opening plate for providing access to a lower thread holding bobbin of a sewing machine which includes a bed frame formed with a cutout opening, a horizontal full rotation loop taker rotatably held in said cutout opening, a bobbin carrier inserted in the horizontal full rotation loop taker in such a way that it can be stopped in rotation while the horizontal full rotation loop taker is rotated, a thread tension adjusting device mounted at said bobbin carrier, a lower thread holding bobbin insertable in said bobbin carrier, and a needle plate secured to said bed frame at said cutout opening, the opening plate which closes and opens said cutout opening being provided on an upper surface thereof with a drawing of said bobbin which overlaps the bobbin inserted in said bobbin carrier when said opening plate is closed, a drawing of said thread tension adjusting device at a required position of the thread tension adjusting device, and a drawing of correct path of a lower thread so as to inform a user about a correct position of the lower thread in the sewing machine.

DETAILED DESCRIPTION OF PREFERRED EMBODIMENT OF THE INVENTION

Figure 1:
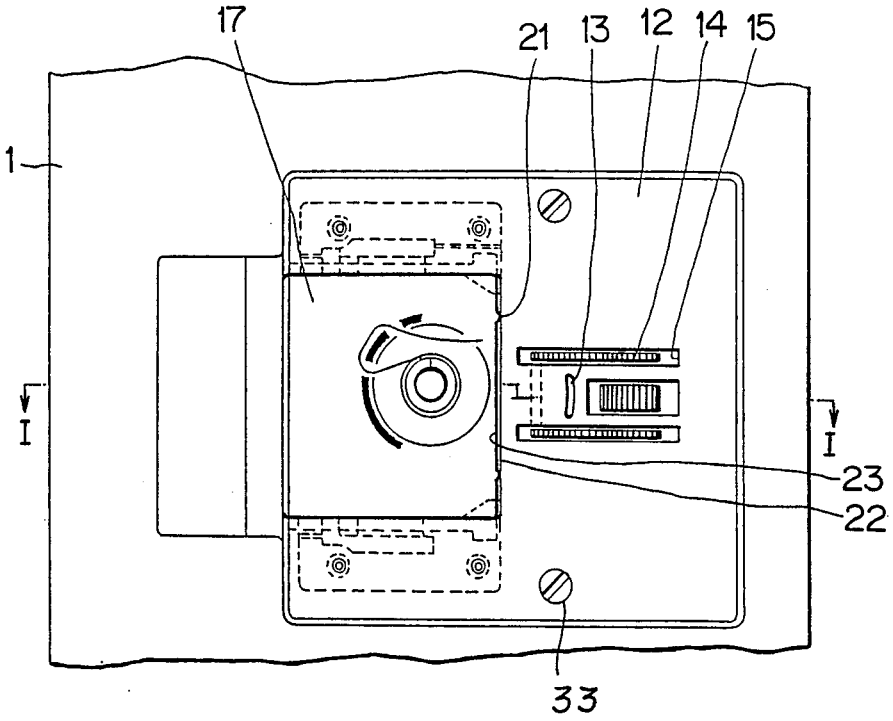
FIG. 1 shows a top plan view of the device of the present invention.
Figure 2:
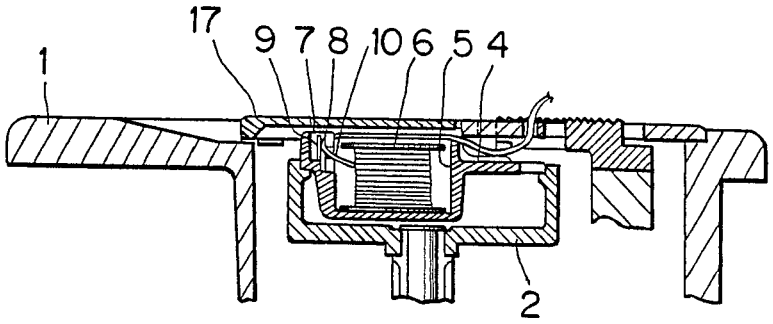
FIG. 2 shows a side view of the device of FIG. 1.
Figure 3:
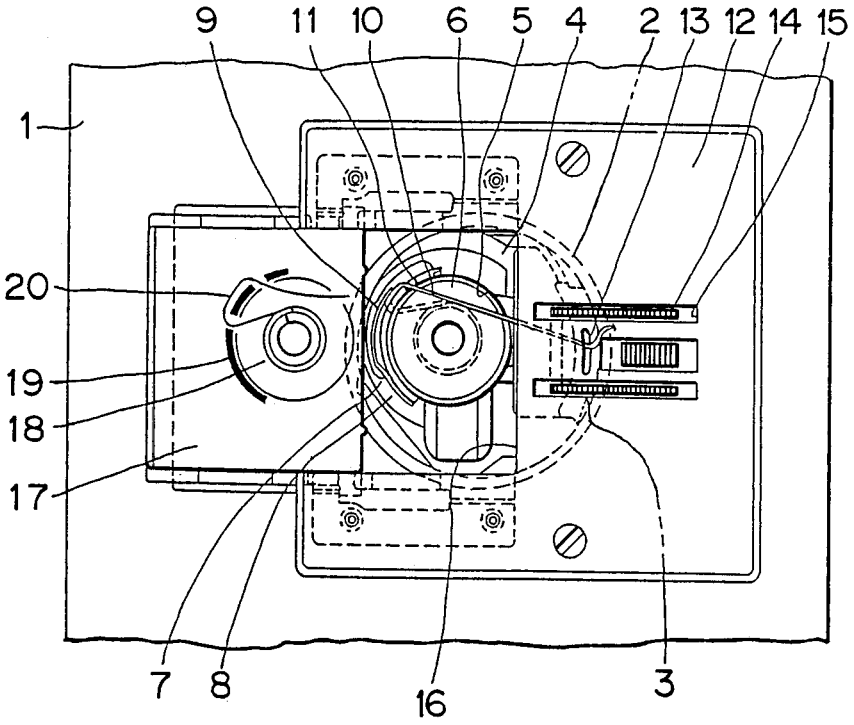
FIG. 3 shows a top plan view illustrating the device in service.

As seen from FIGS. 1 to 3, a working bed frame 1 of a sewing machine rotatably holds therein a horizontal full rotation loop taker device 2 provided with a hook 3 at a part of an outer circumferential wall thereof. The hook 3 crosses in synchronism with a vertically moving needle secured to a needle bar fixed to an arm frame (not shown) disposed at the upper part of the bed frame 1, and catches an upper thread passing through a needle eye so as to form stitches with the lower thread.

A bobbin carrier 4 is mounted on the horizontal full rotation loop taker 2 in such a way that the bobbin carrier is stopped by means of a rotation stopping member while the loop taker 2 is rotated. The bobbin carrier 4 is formed with a circular recess 5 in which a lower thread bobbin 6 is inserted.

A thread tension adjusting device 7 is disposed at the circumferential wall of the recess 5, and this device 7 comprises a bed plate 8 of circular shape and having the same radius as that of the circumferential wall of recess 5, and an elastic plate 9 which adjusts a space between that wall and the bed plate 8.

A released end of the thread 10 wound on the bobbin 6 passes through a cutout of the bed plate 8, and between the outer circumferential wall of the bed plate 8 and the inner wall of the elastic plate 9, further passes through a second cutout 11 of the bed plate 8, the upper part of the bobbin 6, and through the needle hole 13 formed in a needle plate 12. Thus the thread is supplied for forming stitches.

The needle plate 12 is secured by tightening screws 33 to a cutout opening formed in the bed frame 1 for protecting the horizontal full rotation loop taker device 2, and is formed at one part with a cutout 15, through which a feed dog 14 is exposed, and at the other part with an opening 16 (FIG. 3) for inserting the lower thread bobbin 6 in the bobbin carrier 4. Said opening 16 is provided with an opening plate 17 which is made of a transparent synthetic resin and is movable by supporting its both end portions. The surface of plate 17 is at the same level as the surface of said needle plate 12 which is slightly higher than the surface of the bed frame 1.

The opening plate 17 is provided with a drawing 18 of a bobbin on its surface in such a manner that this bobbin drawing 18 exactly overlap the bobbin which is positioned underneath when the plate 17 is completely closed. A drawing 19 of a a required position of the thread tension adjusting device 7, and a normal path of the drawing 20 of a lower thread are also provided on the upper surface of plate 17. It is preferable that the part showing the bobbin drawing 18 be transparent, while the outer parts of the drawings 19 and 20 be opaque.

Numeral 21 designates a projection formed at a front end 22 of the plate 17 for contacting a side end 23 of the opening 16.

The plate 17 is opened and the bobbin 6 having the lower thread is inserted in the bobbin carrier 4. If the thread on the bobbin 6 is passed through the path corresponding to that of the drawing 20 on the opening plate 17, the thread is correctly set. If the plate 17 is closed and the sewing machine is driven, the lower thread is drawn by the upper thread. The thread as it is gradually consumed may be observed through the transparent part of the bobbin drawing 18, so that the sewing machine can be driven until the thread is used up.

Thus, this device brings about effects that the beginner can easily handle it.

It will be understood that each of the elements described above, or two or more together, may also find a useful application in other types of plates for attaching lower thread bobbins of sewing machines differing from the types described above.

While the invention has been illustrated and described as embodied in a plate for attaching a lower thread bobbin of a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An opening plate for providing access to a lower thread holding bobbin of a sewing machine which includes a bed frame formed with a cutout opening, a horizontal full rotation loop taker rotatably held in said cutout opening, a bobbin carrier inserted in the horizontal full rotation loop taker in such a way that it can be stopped in rotation while the horizontal full rotation loop taker is rotated, a thread tension adjusting device mounted at said bobbin carrier, a lower thread holding bobbin insertable in said bobbin carrier, and a needle plate secured to said bed frame at said cutout opening, the opening plate which closes and opens said cutout opening being provided on an upper surface thereof with a drawing of said bobbin which overlaps the bobbin inserted in said bobbin carrier when said opening plate is closed, a drawing of said thread tension adjusting device at a required position of the thread tension adjusting device, and a drawing of correct path of a lower thread so as to inform a user about a correct position of the lower thread in the sewing machine.

* * * * *